US005094439A

United States Patent [19]

Renner et al.

[11] Patent Number: 5,094,439

[45] Date of Patent: Mar. 10, 1992

[54] DEVICE FOR LOCKING A SUCTION NOZZLE OF A SEPARATING SUCKER ON A SUCTION HEAD OF A SHEET FEEDER

[75] Inventors: Jochen Renner; Peter Sobota, both of Heidelberg, Fed. Rep. of Germany

[73] Assignee: Heidelberger Druckmaschinen AG, Heidelberg, Fed. Rep. of Germany

[21] Appl. No.: 689,312

[22] Filed: Apr. 22, 1991

[30] Foreign Application Priority Data

Apr. 21, 1990 [DE] Fed. Rep. of Germany ..... 4012779

[51] Int. Cl.[5] ..... B65H 3/08

[52] U.S. Cl. ..... 271/103; 271/104; 271/107

[58] Field of Search ..... 271/90, 102, 103, 104, 271/107, 108; 221/211; 414/797

[56] References Cited

U.S. PATENT DOCUMENTS 2,476,577 7/1949 Backhouse ..... 271/104 X
4,786,643 11/1988 Jiruse et al. ..... 271/103

FOREIGN PATENT DOCUMENTS 580769 9/1924 France ..... 271/104
787721 5/1960 France ..... 271/104

*Primary Examiner*—H. Grant Skaggs
*Assistant Examiner*—Carol Lynn Druzbick
*Attorney, Agent, or Firm*—Herbert L. Lerner; Laurence A. Greenberg

[57] ABSTRACT

Device for locking a suction nozzle of a separating sucker on a suction head of a sheet feeder of a sheet-processing machine, the suction head having at least one governor foot, a drive device for moving the governor foot in accordance with a working cycle of the feeder, and a device for vertically moving the nozzle of the separating sucker, includes a bearing support laterally disposed on the suction nozzle, a movably arranged abutment device for supporting the bearing support, when the suction nozzle is in a lifted position, until a trailing edge of a sheet supplied to the feeder has left the vicinity of the suction nozzle of the separating sucker, and a linkage connecting the abutment device articulatingly to the drive device for the governor foot for moving the abutment in accordance with a working cycle of the suction head.

10 Claims, 4 Drawing Sheets

DEVICE FOR LOCKING A SUCTION NOZZLE OF A SEPARATING SUCKER ON A SUCTION HEAD OF A SHEET FEEDER

The invention relates to a device for locking a suction nozzle of a separating sucker on a suction head of a sheet feeder of a sheet processing machine and, more particularly, wherein the suction head has at least one governor foot, drive means for moving the governor foot in accordance with a working cycle of the feeder, and means for vertically moving the suction nozzle.

German Patent 23 09 013 discloses a device of the foregoing general type which finds application when spring suckers are used as separating suckers and when the lifting motion of the separating sucker is performed without any special drive means. In the device according to the German patent, the suction head is provided with a lever which is mounted so as to be pivotable about a horizontal axis, has a cam roller or follower cooperating with a control cam and further has, at its free end, a cross-bar for holding up the separating nozzles. A bearing support is formed by two rollers which are mounted on respective ends of the cross-bar and cooperate with flanges extending horizontally to the suction nozzles of the separating suckers. The means for locking the suction nozzle of the separating sucker thus have a separate drive with its own control cam by means of which the suction nozzle of the separating sucker is automatically moved downwardly the instant the trailing edge of the sheet is supplied to the feeder has left the vicinity of the suction nozzle of the separating sucker.

German Patent 891 267 discloses a device for locking a suction nozzle of a separating sucker mounted on a suction head of a sheet feeder and executing an oscillatory motion, a pawl in the form of a double lever being pivotally mounted on the separating sucker, one arm of the lever having an abutment for a nose or projecting part provided on the suction nozzle and other arm cooperating with a stop provided on a pile detector or sensor. The separating sucker is constructed as a spring sucker so that, in a rear swivel position thereof, the suction nozzle springs upwardly after it has sucked in the uppermost sheet on the sheet pile, the abutment of the pawl then engages behind the nose or projecting part of the suction nozzle and holds it in the upper position until the trailing edge of the sheet supplied to the feeder has left the vicinity of the suction nozzle which has been aerated in the interim. Upon the return of the separating sucker which, together with the suction nozzle, moves oscillatingly on a sheet path into the rear end position, the stop provided on the pile detector or sensor releases the locking mechanism so that the suction nozzle drops downwardly.

It is accordingly an object of the invention to provide a mechanism for locking a separating sucker in the form of a spring sucker in the upper end position with a forcibly controlled release of a suction nozzle in a suction head in accordance with a working cycle of the suction head and with a governor foot being applied onto the trailing edge of a sheet pile, which avoids the disadvantages of heretofore known devices of this general type.

With foregoing and other objects in view, there is provided, in accordance with the invention, a device for locking a suction nozzle of a separating sucker on a suction head of a sheet feeder of a sheet-processing machine, the suction head having at least one governor foot, drive means for moving the governor foot in accordance with a working cycle of the feeder, and means for vertically moving the suction nozzle of the separating sucker, comprising a bearing support laterally disposed on the suction nozzle, movably arranged abutment means for supporting the bearing support, when the suction nozzle is in a lifted position, until a trailing edge of a sheet supplied to the feeder has left the vicinity of the suction nozzle of the separating sucker, and linkage means connecting the abutment means articulatingly to the drive means for the governor foot for moving the abutment in accordance with a working cycle of the suction head.

In accordance with another feature of the invention, the drive means for the governor foot comprise a pair of linkages articulatingly connected by a toggle-like joint having a link pin, and wherein the abutment means are formed on a sliding block mounted on the link pin and are guidable rotatably at a fixed location of the suction head and linearly displaceably tangentially to the axis of the joint.

Such a construction requires neither an additional drive nor an additional control for locking the separating sucker in the lifted position thereof. The counter-support or abutment is moved forcibly together with the governor foot, and the bearing support of the suction nozzle is released only before the following sheet is to be lifted from the pile. The suction nozzle of the separating sucker then drops downwardly due to its own weight and, if necessary or desirable, with the aid of a spring force, and springs upwardly again into the upper end position thereof due to the action of negative pressure or partial vacuum applied in the separating sucker.

In accordance with a further feature of the invention, the sliding block is bifurcated and is formed with a recess between the bifurcation thereof, and including a pin fixedly fastened to the suction head, the pin being received in the recess between the bifurcations.

In accordance with an added feature of the invention, the link pin has a pivot bearing whereon the bifurcated sliding block is pivotable eccentrically to a central axis thereof.

In accordance with an additional feature of the invention, the bearing support is formed on the suction nozzle and the abutment means are formed plate-like on the sliding block.

In accordance with again another feature of the invention, the abutment means comprise a leaf spring fastened to the suction head, and including a release lever mounted on the suction head and articulatingly connected to the drive means for the governor foot, the release lever cooperatively engaging the leaf spring so that the leaf spring releases the bearing support on the suction nozzle when the governor foot is moved towards a sheet pile.

In accordance with again a further feature of the invention, the release lever is formed with two arms, one of the arms being articulatingly connected to the drive means for the governor foot, and the other of the arms engaging the leaf spring.

In accordance with again an added feature of the invention, there is provided means for operating by suction air the means for vertically moving the suction nozzle of the separating sucker.

In accordance with again an additional feature of the invention, there is provided spring means for supplementarily operating spring means for supplementarily operating the last-mentioned means by spring force.

In accordance with a concomitant feature of the invention, the pin is partly enclosed in the recess by the bifurcations of the sliding block and is formed by a blowing tube for supplying blowing air.

Other features which are considered as characteristic for the invention are set forth in the appended claims.

Although the invention is illustrated and described herein as embodied in a device for locking a suction nozzle of a separating sucker on a suction head of a sheet feeder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
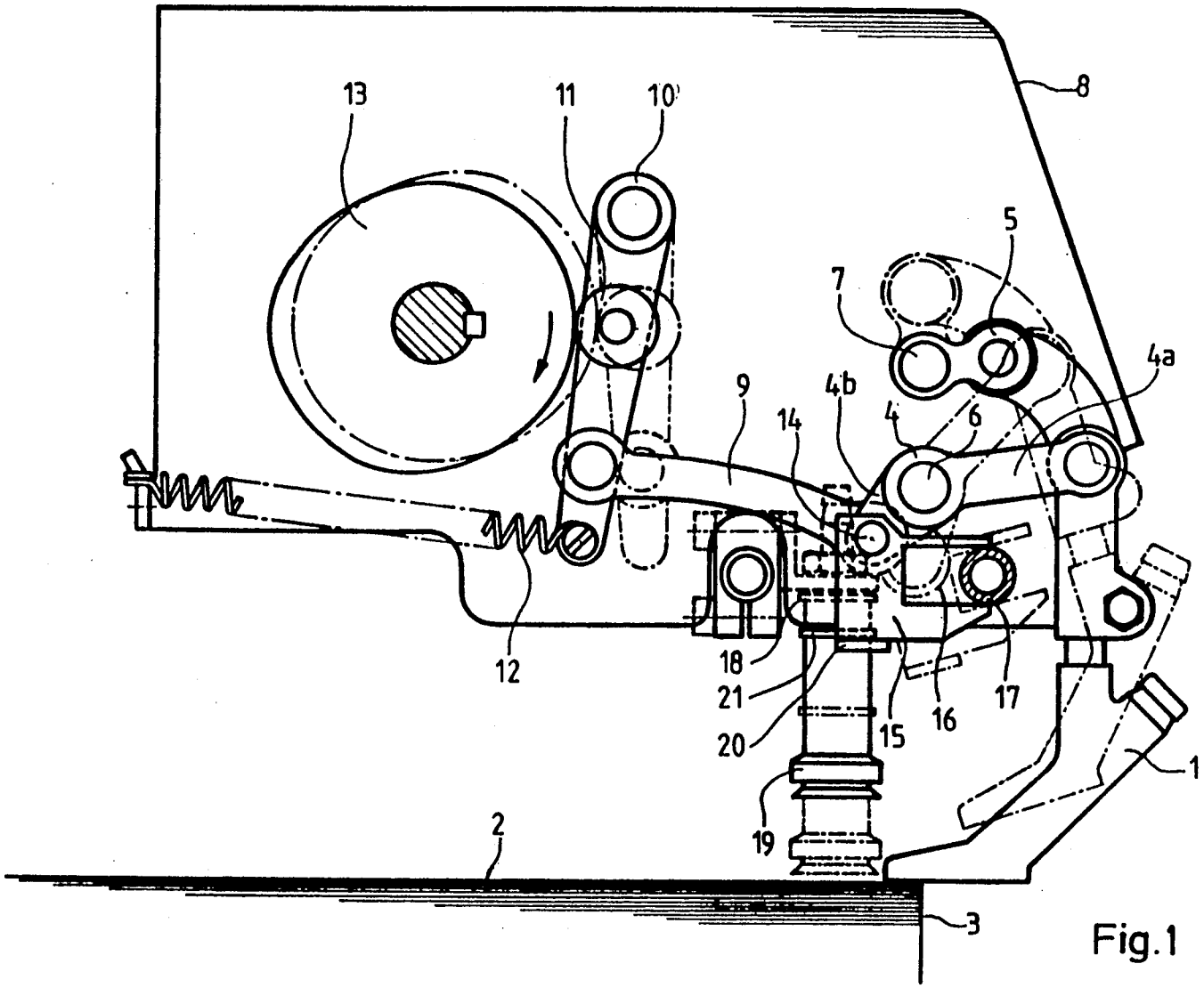
FIG. 1 is a side elevational view of a first embodiment of a device for locking a suction nozzle of a separating sucker on a suction head of a sheet feeder having a locking mechanism according to the features of the invention.

Referring now to the drawings and, first, particularly to FIG. 1 thereof, there is shown therein a suction head of a sheet feeder of a sheet-processing machine having a governor or sensor foot 1 which, in accordance with the working cycle of the suction head, is applicable to a trailing edge of an uppermost sheet 2 of the sheet pile 3 and is pivotable back into a lifted end position thereof. For this purpose, the governor foot is linked, on the one hand, to a free end of one arm 4*a* of a double lever 4 and, on the other hand, to a control lever 5, both of the levers being mounted on a housing 8 of the suction head so as to pivot about axes 6 and, respectively, extending transversely to a sheet-conveying direction, the levers 4 and 5 being adjusted with respect to each other so that the governor foot 1 pivots from the position thereof shown in solid lines into the position thereof shown in phantom and back and forth again. With respect to a means for driving the linkages, the other arm 4*b* of the double lever 4 is articulatingly connected to one end of a connecting rod 9, the other end of the connecting rod 9 being linked to a roller lever 10, the roller lever 10 being articulatingly mounted at one end thereof on the housing 8 and bearing a cam roller 11 which is pressed against the periphery of a driven cam disk 13 by means of a spring 12 acting on the other end of the roller lever 10. Thus, this cam disk 13 controls the movement of the governor foot 1 in accordance with the working cycle of the suction head. A sliding block 15 is pivotable on a link pin 14 of a joint acting as a toggle-lever between the connecting rod 9 and the lever arm 4*b* of the double lever 4, the sliding block 15 being bifurcated and formed between the bifurcations with a recess 16, by which it is slidable onto a blowing tube 17 firmly attached to the housing 8 for the purpose of supplying blowing air to sheet-separating blowers or the like, so that the sliding block 15 formed with the recess 16 is moved synchronously with the governor foot 1 from the position of the latter shown in solid lines in FIG. 1 to the position thereof shown in phantom, and back again.

The separating sucker 18 is constructed as a spring and is fastened to the housing 8. When subjected to an atmospheric internal pressure, the lower part of the spring sucker as shown in FIG. 1, including the suction nozzle 19, drops into the lower end position thereof shown in phantom, due to its own weight and, if necessary or desirable, with the aid of an internal spring 30 (FIG. 2) so that the suction nozzle 19 rests on the uppermost sheet 2 of the sheet pile 3. When it is supplied with negative pressure or partial vacuum, the suction nozzle 19 springs into the upper end position thereof shown in solid lines, thus simultaneously lifting the trailing edge end of the uppermost sheet 2 on the sheet pile 3. In so doing the governor foot 1 is pivoted back into the rear position thereof represented in phantom. Non-illustrated forwarding suckers then take over the lifted sheet 2 and convey it toward the non-illustrated feeder located on the left-hand side of FIG. 1. The governor foot simultaneously returns to the solid-line position thereof, the sliding block 15 being pivoted into the solid-line position thereof, as well. A counter-support on abutment 20 fastened to the sliding block 15 thus engages under a bearing support 21 provided laterally on the suction nozzle 19, thereby locking the suction nozzle 19 in the upper position thereof so that it does not drop back into the lower position thereof when there is no negative pressure or partial vacuum in the suction nozzle 19, the governor foot 1 being meanwhile pivoted into the solid-line position thereof. Thereafter, the governor foot 1 pivots back into the phantom position thereof and, simultaneously, the sliding block 15, together with the counter-support or abutment 20 attached thereto, releases the bearing support 21 provided on the suction nozzle 19 so that the suction nozzle 19 also drops into the lower end position thereof when in phantom and is again able to be supplied with negative pressure or partial vacuum for lifting the next and newly uppermost sheet from the sheet pile 3.

Figure 2:
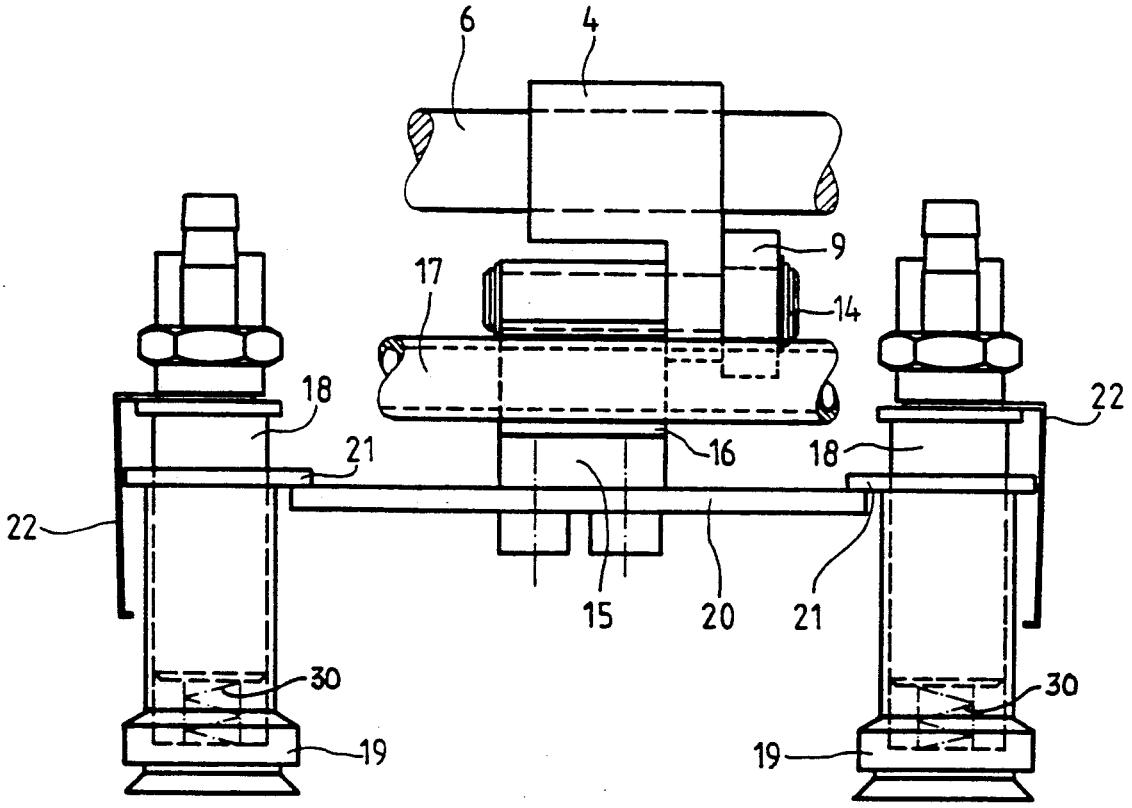
FIG. 2 is a rear end view of the device according to FIG. 1 as seen from the right-hand side of the latter figure, with a governor or sensor foot and a linkage for moving it omitted.

FIG. 2 illustrates an arrangement of a pair of separating suckers 18 which may be disposed at a spaced distance from one another symmetrically to the middle longitudinal plane of the suction head. Moreover, conventional guiding springs 22 are shown which secure the suction nozzles 19 of the separating suckers 18 against rotation and mark the lower end position of the suction nozzles 19.

Figure 3:
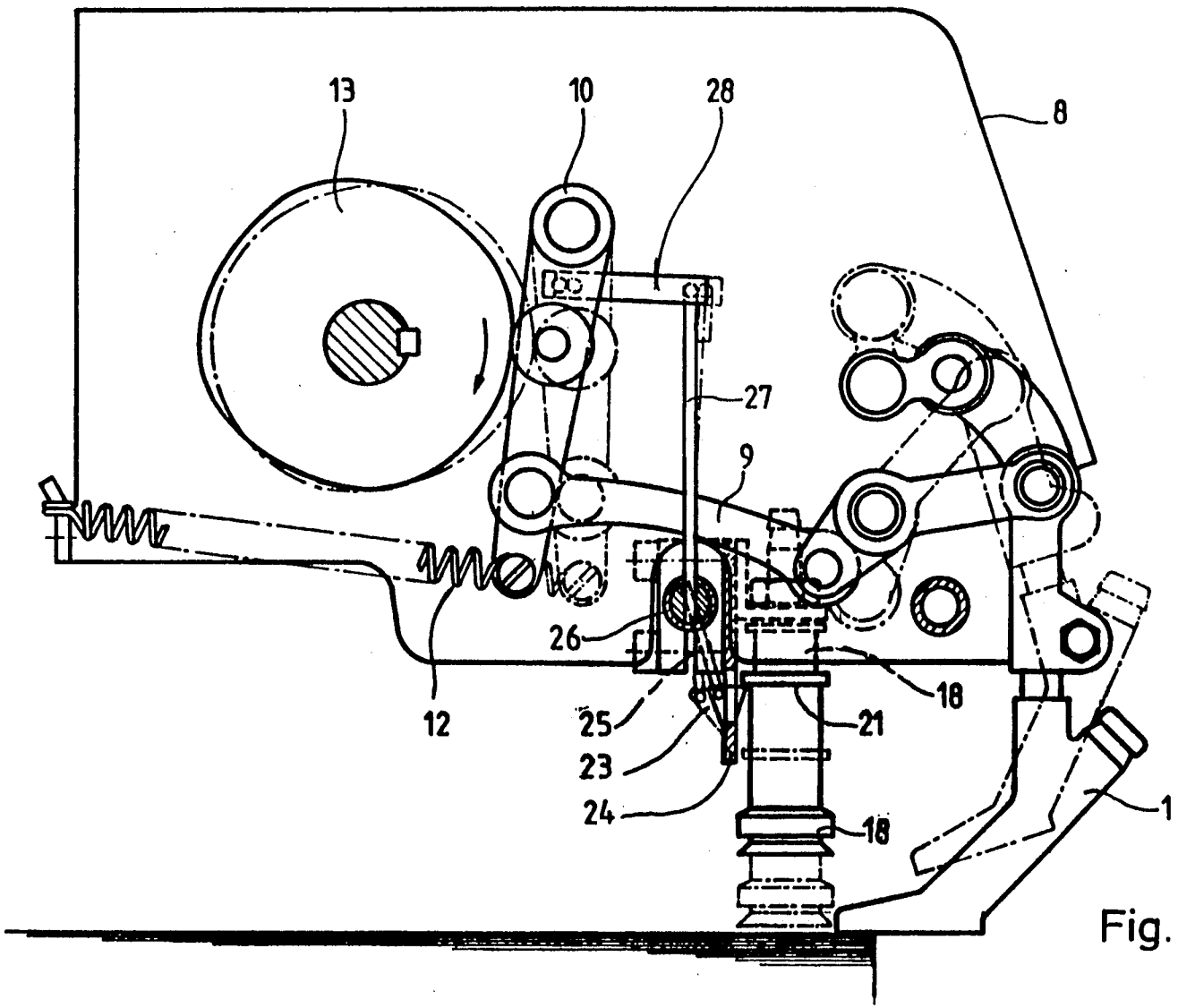
FIG. 3 is a side elevational view like that of FIG. 1, of a second embodiment of the locking device.
Figure 4:
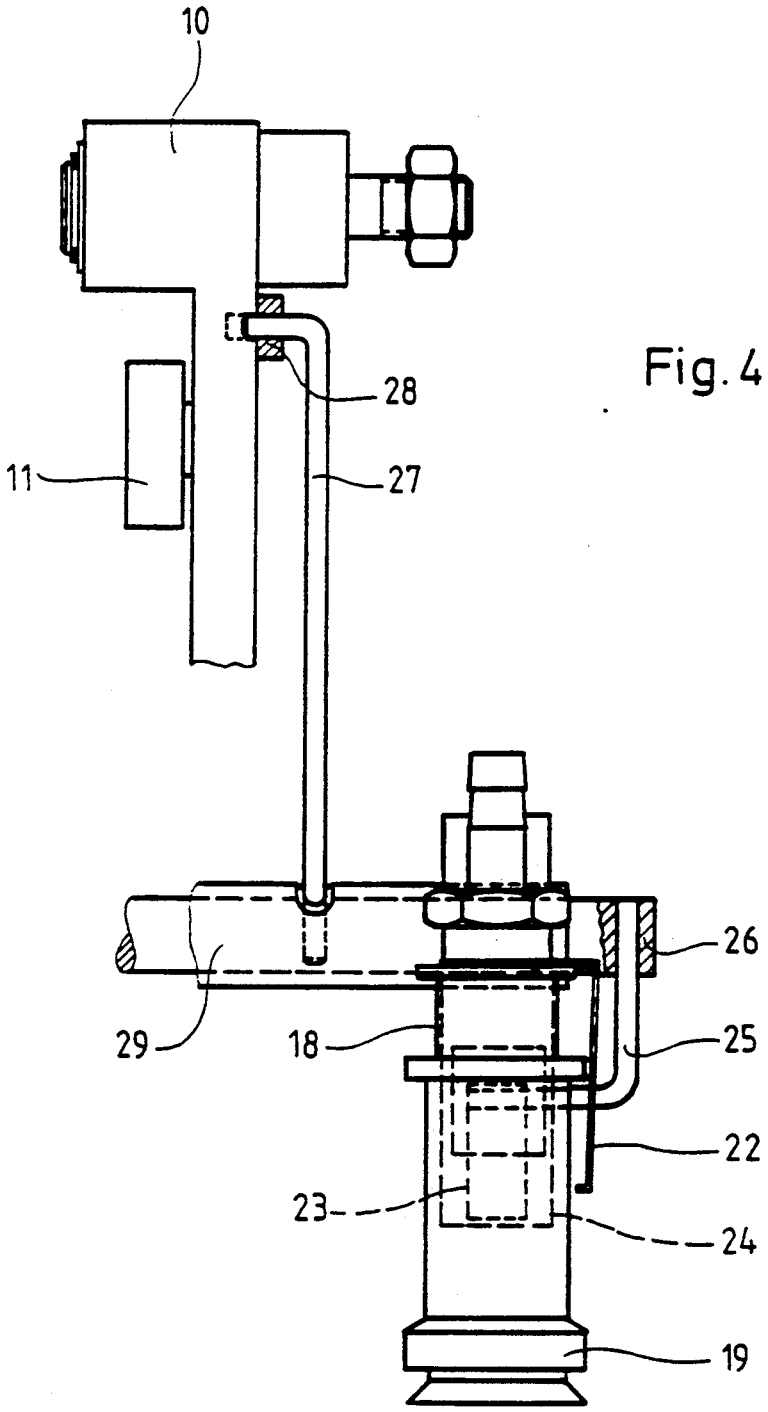
FIG. 4 is a rear end view like that of FIG. 2 of the embodiment according to FIG. 3.

In the embodiment of FIGS. 3 and 4, the arrangement of the governor foot 1 and the drive means for the governor foot 1 correspond to the arrangement set forth hereinbefore in the description of the embodiment of FIGS. 1 and 2. For the purpose of locking the separating sucker 18 and its suction nozzle 19 in the upper position thereof, a leaf spring 23 is provided as a counter-support or abutment for the bearing support 21, and constitutes a modification of the embodiment represented in FIG. 1 and 2, the leaf spring 23 being fastened to a plate 24 which extends downwardly from the housing 8 of the suction head alongside the separating sucker 18. A nose-like profile of the leaf spring 23, as seen from the side thereof, extends through a recess formed in the plate 24 and forms the counter-support or abutment for the bearing support 21 provided on the suction nozzle 19 of the separating sucker 18. The solid-line position of engagement of the counter-support or abutment 23 and the bearing support 21 corresponds to the non-tensioned or relieved state of the leaf spring 23. To unlock or unlatch the connection between the bearing support 21 and the abutment 23, a release lever 25 is provided which, at one end thereof engages in the profile of the leaf spring 23 and, at the other end thereof is attached to a swivelling shaft 26 which is connected to the roller lever 10 via a swivelling lever 27 and a connecting strap 28. Consequently, a swivelling movement of the roller lever 10 executed to the right-hand side so as to lift the governor foot 1 from the trailing edge of the sheet pile 3 causes a swivelling movement of the release lever 25 to be executed in the opposite direction so that the release lever 25 withdraws the nose of the leaf spring 23 forming the counter-support or abutment from the vicinity of the bearing support 21 on the suction nozzle 19, thereby enabling the suction nozzle 19 to drop into the lower end position thereof. The instant the governor foot 1 begins to pivot back into the phantom position thereof, the leaf spring 23 is relieved of tension so that it returns to a waiting position in which the locking mechanism becomes effective. For this purpose, the profile of the leaf spring 23 is formed with an inclined glide surface so that, due to the elastic deformation of the leaf spring 23, the bearing support 21 can pass the leaf spring 23 and reach the upper end position of the suction nozzle 29. As to the double-sided construction of the embodiment of FIG. 2 resulting in a separating sucker pair, the swivelling shaft 26 is mounted in a tube 29 which, at one or more locations thereof, is firmly fastened to the housing 8 of the suction head and is formed at the circumference thereof with slit-like recesses through which the swivelling lever 27 connected to the swivelling shaft 26 extends.

The foregoing is a description corresponding in substance to German Application P 40 12 779.6, dated Apr. 21, 1990, the International priority of which is being claimed for the instant application, and which is hereby made part of this application. Any material discrepancies between the foregoing specification and the aforementioned corresponding German application are to be resolved in favor of the latter.

We claim:

1. Device for locking a suction nozzle of a separating sucker on a suction head of a sheet feeder of a sheet-processing machine, the suction head having at least one governor foot, drive means for moving the governor foot in accordance with a working cycle of the feeder and means for vertically moving the nozzle of said separating sucker, said device comprising a bearing support laterally disposed on the suction nozzle, movably arranged abutment means for supporting said bearing support, when the suction nozzle is in a lifted position, until a trailing edge of a sheet supplied to the feeder has left the vicinity of the suction nozzle of the separating sucker, and linkage means connecting said abutment means articulatingly to the drive means for the governor foot for moving said abutment means in accordance with a working cycle of the suction head.

2. Device according to claim 1, wherein the drive means for the governor foot comprise a pair of linkages articulatingly connected by a toggle-like joint having a link pin, and wherein said abutment means are formed on a sliding block pivotally mounted on said link pin and are guidable rotatably at a fixed location of the suction head and linearly displaceably tangentially to the axis of said joint.

3. Device according to claim 2, wherein said link pin has a pivot bearing whereon said bifurcated sliding block is pivotable eccentrically to a central axis thereof.

4. Device according to claim 2, wherein said sliding block is bifurcated and is formed with a recess between the bifurcations thereof, and including a pin fixedly fastened to the suction head, said pin being received in said recess between said bifurcations.

5. Device according to claim 4, wherein said pin is partly enclosed in said recess by said bifurcations of said sliding block and is formed by a blowing tube for supplying blowing air.

6. Device according to claim 1, wherein said bearing support is formed on said suction nozzle and said abutment means are formed plate-like on said sliding block.

7. Device according to claim 1, wherein said abutment means comprises a leaf spring fastened to the suction head, and including a release lever mounted on said suction head and articulatingly connected to the drive means for the governor foot, said release lever cooperatively engaging said leaf spring so that said leaf spring releases said bearing support on the suction nozzle when the governor foot is moved towards a sheet pile.

8. Device according to claim 7, wherein said release lever comprises two arms with one of said arms being articulatingly connected to the drive means for the governor foot, and the other of said arms engaging said leaf spring.

9. Device according to claim 1, including means for operating by suction air the means for vertically moving the suction nozzle of the separating sucker.

10. Device according to claim 9, including spring means for supplementarily operating the last-mentioned means by spring force.

* * * * *